United States Patent [19]

Greenstreet

[11] Patent Number: 5,002,525

[45] Date of Patent: Mar. 26, 1991

[54] MILITARY DECOY

[75] Inventor: Philip J. Greenstreet, Rosemead, Calif.

[73] Assignee: Metromedia Company, Secaucus, N.J.

[21] Appl. No.: 382,115

[22] Filed: Jul. 19, 1989

[51] Int. Cl.[5] ..... B31D 5/00

[52] U.S. Cl. ..... 493/374; 273/348; 446/94; 29/458

[58] Field of Search ..... 273/348; 29/458, 469; 493/374, 379; 446/94

[56] References Cited

U.S. PATENT DOCUMENTS 4,625,972 12/1986 Task et al. ..... 434/11

*Primary Examiner*—Frederick R. Schmidt
*Assistant Examiner*—Jack W. Larinder
*Attorney, Agent, or Firm*—McCormick, Paulding & Huber

[57] ABSTRACT

A military hardware item, such as an aircraft fighter, is simulated in the field by the fabric sheets and light weight plastic panels stored in a cylindrical canister. The canister opens to provide two semi-cylindrical half sections that are laid end-to-end or side-by-side on a black shadow sheet. Imprinted sheets simulate the aircraft's details and are laid over these canister sections. Other aircraft regions are simulated by contoured panels and struts secured to these panels support still other sheets to simulate the aircraft's non-horizontal flight surfaces.

9 Claims, 3 Drawing Sheets

MILITARY DECOY

This invention relates generally to the art of fabricating transporting and deploying military decoys, and deals more specifically with a method for providing a realistic inexpensive light weight decoy designed for portability, and ease of erection. The three dimensional decoy is small enough to enable up to four units to be transported on a standard military pallet. It is designed to be produced inexpensively, and is adapted to be quickly assembled or disassembled by very few people in a relatively short period of time. The low weight design is a significant factor. The decoy can be carried easily by four people.

SUMMARY OF INVENTION

In accordance with the method of the present invention a generally canister is made up of at least two half sections. The canisters can be easily grouped with other such canisters for ease in transportation on a standard military pallet. The canister has a length of approximately eight feet and a diameter or height of approximately four feet. Each canister contains plurality of normally flat fabric sheets rolled up and stored inside the canister. Several support struts are also provided inside the canister. Contoured three dimensional panels are also provided in nested relationship inside or outside the rolled up sheets to simulate certain parts of a particular military weapon system (as for example the nose, canopy, tip tanks, armament, and engine inlets of a fighter aircraft).

A black shadow sheet is laid on a generally flat horizontal surface to assembly of the decoy. The canister sections are placed end-to-end or side-by-side over the shadow sheet. A second sheet, imprinted with the features of a central portion of the airplane, as for example the wing, is laid across the top of the canister sections, and support struts are secured to the panels or to these canister sections to provide a convenient means for securing additional imprinted sheets to these struts to simulate other components, such as non-horizontal aircraft control surfaces for example.

The assembly is arranged so that the shadow is offset slightly from the assembled components to create the realistic likeness of the actual military hardware when viewed from above or from a significant elevational relative to the decoy itself.

DETAILED DESCRIPTION OF FIGS. 1–9

Figure 1:
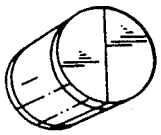
FIG. 1 is a view of the canister in its assembled condition with the various components of a preferred embodiment provided therein.
Figure 2:
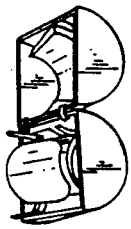
FIG. 2 is a view of the canister after it has been opened.

Turning now to the drawings in greater detail, FIG. 1 shows a preferred form for a canister constructed in accordance with the present invention, the canister having a generally cylindrical shape when assembled, and comprising at least two canister half sections of generally semi-circular configuration. The length of the canister is on the order of eight feet and the height or diameter of the canister is on the order of four feet. The canister is shown in FIG. 2 with several normally flat but rolled sheets of printed plastic fabric, preferably acrylic or vinyl coated, stored therein. The fabric material is imprinted with accurate representations of the various features of a particular military aircraft such as an F-16.

Figure 3:
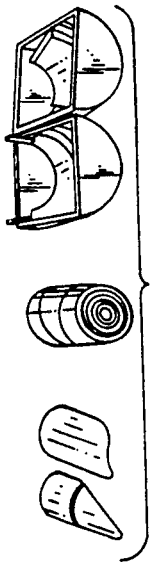
FIG. 3 is a view of the canister after having been opened and after removal of the various imprinted sheets and removal of the various contoured decoy parts.
Figure 4:
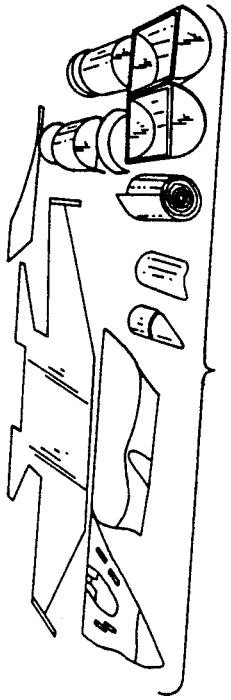
FIG. 4 is a view of the imprinted sheets laid flat on the ground and the contoured panels also provided in exploded relationship preparatory to assembly.
Figure 5:
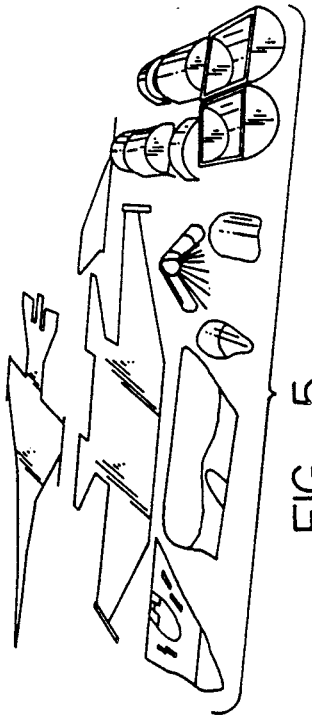
FIG. 5 is a view similar to FIG. 4 but also illustrates the shadow sheet rolled flat on the ground as the first step in assembling the decoy.

As shown in FIGS. 3, 4 and 5 other components are also stored in the canister. Several three dimensional contoured panels are provided, each being contoured to approximately the geometry of a particular part of a specific aircraft to be simulated. For example a nose section, a canopy, and other parts, such as tip tanks and/or armament, and engine inlets or the like are preferably provided. These three dimensional contoured panels may define further portions of the aircraft or decoy fuselage, but it is an important feature of the present invention that as many components of the decoy as possible are represented by the printed matter on the flat plastic vinyl coated sheet material. The indicia imprinted thereon represent the appearance of the various components of the real thing. This reduces the cost of the decoy and contributes to its portability and ease of assembly and disassembly.

FIG. 5 illustrates the various components of the decoy kit laid out on a horizontal surface, such as a ramp. With particular reference to FIG. 5 it will be apparent that the first sheet to be placed at a predetermined location for assembly of the decoy will generally be a black normally flat sheet to simulate a shadow in planform of at least the wings and horizontal tail surfaces of the aircraft to be simulated by the decoy of the present invention. This black sheet may be staked to the ground, or otherwise secured (as by an adhesive).

Figure 6:
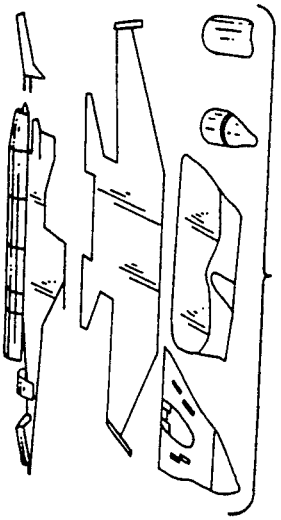
FIG. 6 shows the canister sections assembled in end to end relationship together with assembly of certain three dimensional contoured panels so as to simulate a portion of the aircraft fuselage.

FIG. 6 illustrates a second stage according to the erection method of the present invention where the canister sections are placed end-to-end over the shadow sheet so that the common centerline of these canister sections is generally perpendicular to the span of the wing shadow. Additional fuselage panels may be placed forward or aft of these assembled canister sections to simulate the entire aircraft fuselage. These panels are preferably fabricated from a light weight plastic material such as ABS or the equivalent.

Figure 8:
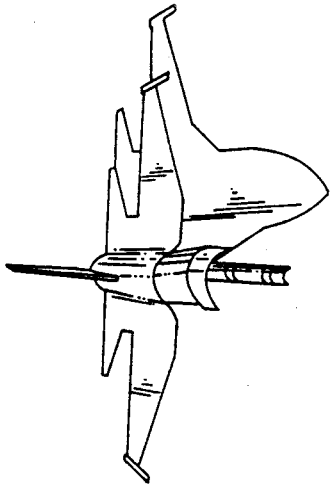
FIG. 8 is a view of the assembly after the wing defining sheet has been placed over the assembly of FIG. 7.

FIG. 8 shows the wing and aft fuselage defining sheet laid over the canister sections and contoured fuselage panels. Note that this sheet is also offset from the shadow sheet for realism.

Figure 7:
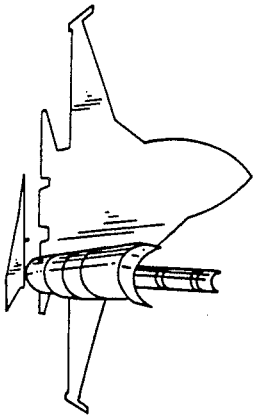
FIG. 7 is a view of the FIG. 6 assembly from a different vantage point.

In order to simulate the aircraft's vertical appearance support struts are included in the kit and are adapted to be inserted into slots provided for this purpose in the fuselage defining panels. These struts may be fabricated from aluminum or a rigid plastic material such as GRP or the equivalent. The struts serve to support additional imprinted sheets to simulate non-horizontal aircraft control surfaces or the like, such as the tail fin shown, laid flat in FIGS. 6 and 7 and shown erected in FIG. 8.

Figure 9:
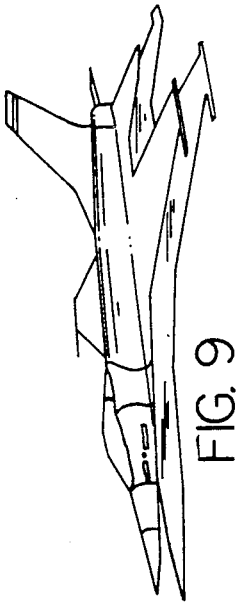
FIG. 9 is a perspective view of the completed decoy.

FIG. 9 shows the decoy after placement of sheets defining the forward fuselage or nose section, and after placement of the canopy panels.

As a result of the placement of the generally flat shadow sheet when taken in combination with the three dimensional, or perhaps more appropriately two and one-half dimensional configuration, of the assembled kit components one is left with the impression of a full scale F16 parked on a ramp or hardstand. (See FIG. 9.) It will be noted that the size of the decoy itself may be full scale, or somewhat less than that of the actual aircraft. While this disclosure relates to aircraft decoys the invention is not so limited and neither is the invention limited to simulating the appearance of a military fighter aircraft. The claims define the limits of the present invention and the following description and disclosure is intended solely for illustrative purposes only.

DETAILED DESCRIPTION OF FIGS. 10–12

Figure 10:
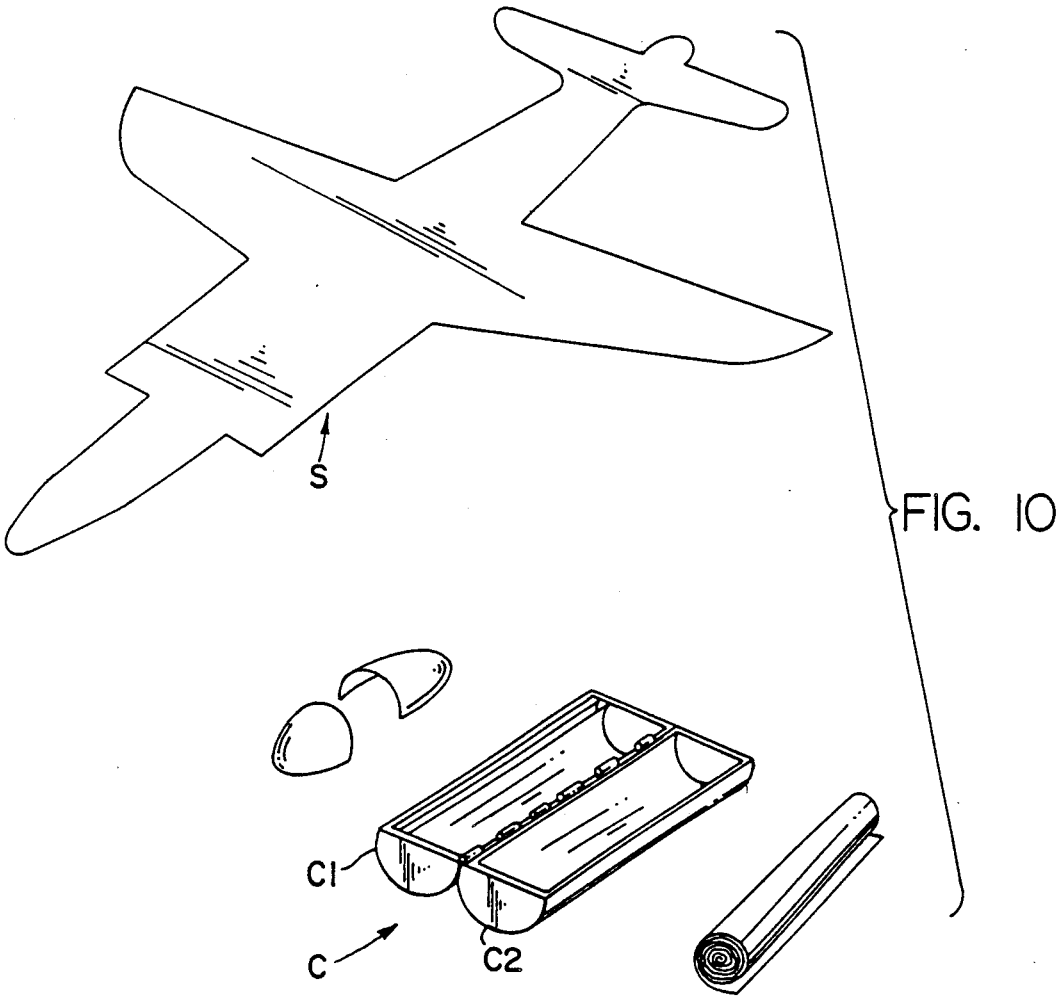
FIG. 10 is a view of an alternative decoy subject with the shadow sheet laid out and the canister opened up.

FIG. 10 shows a canister for a slightly different aircraft, in this case an AV-8B Harrier type aircraft.

The black fabric shadow sheet S is shown flat and the canister C is shown still connected along one lateral edge.

Figure 11:
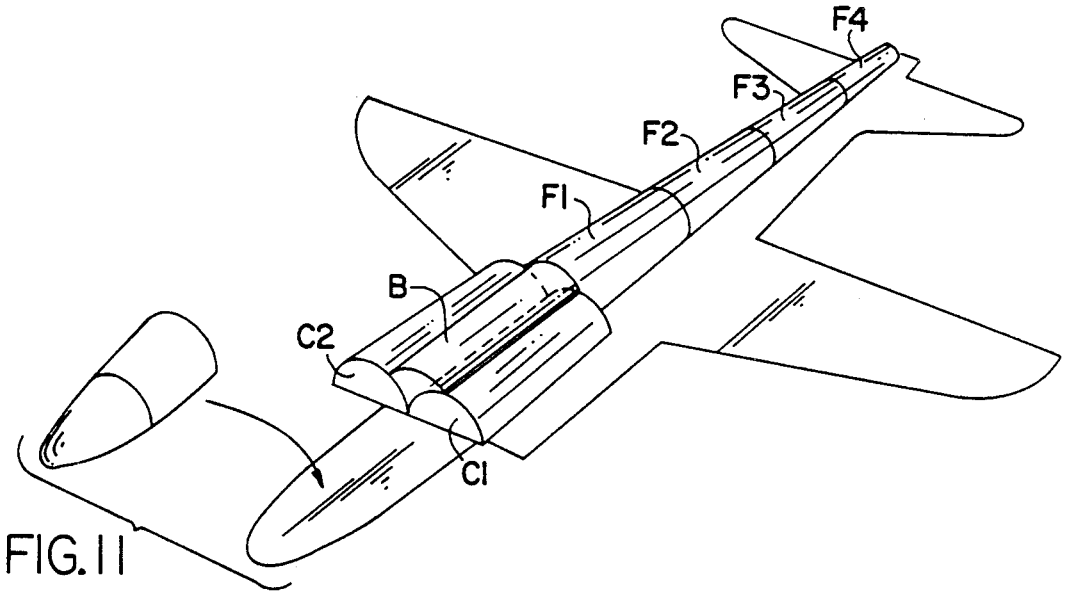
FIG. 11 shows how the canister and aircraft decoy panels are arranged on the plastic shadow sheet.
Figure 12:
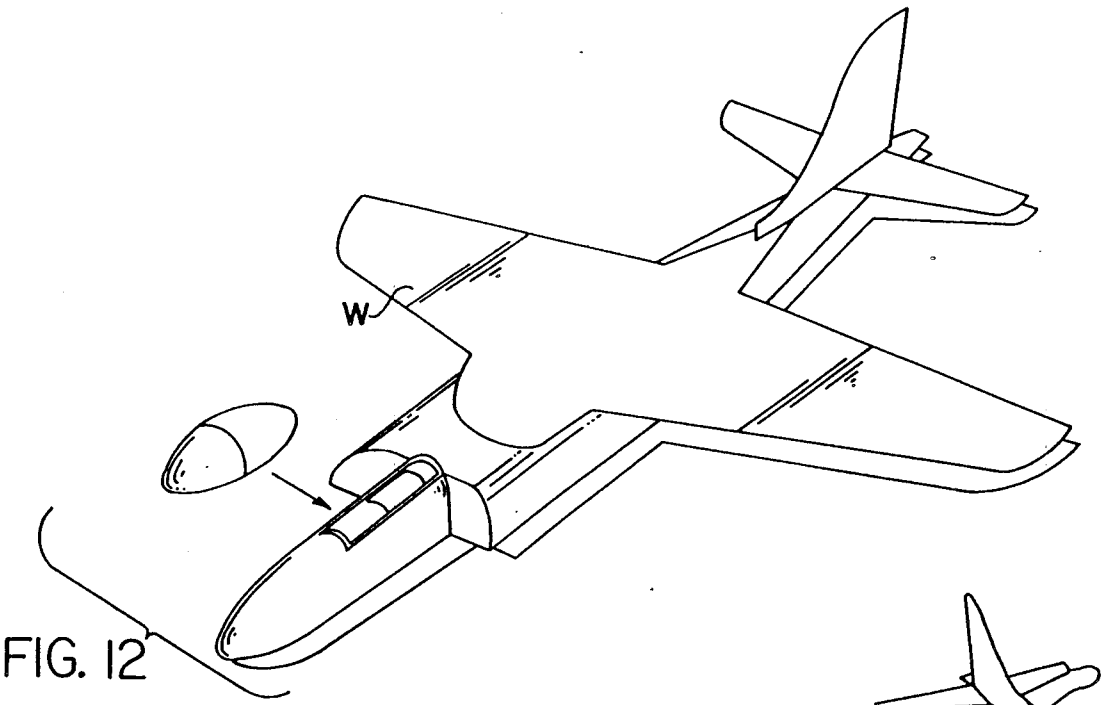
FIG. 12 is a view of the FIG. 11 decoy at a still later stage of construction.
Figure 13:
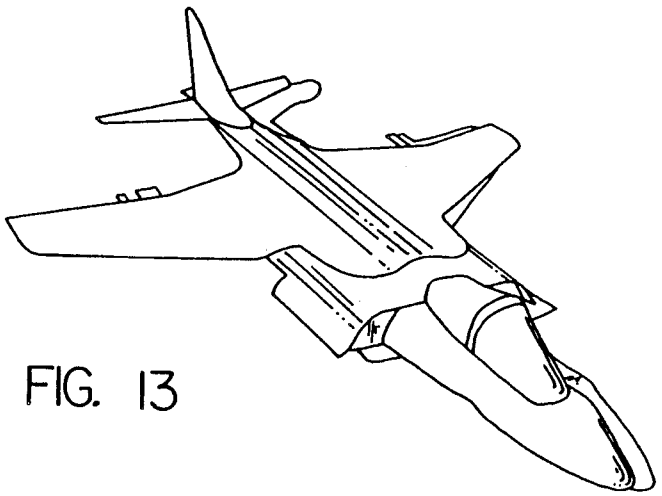
FIG. 13 is a perspective view of the assembled decoy depicted in FIGS. 10–12.

FIG. 11 shows the canister half sections C1 and C2, still connected as in FIG. 10, but laid upside down on the shadow sheets. A concave "bridge" panel B is placed on top of these half sections C1 and C2 and four fuselage components F1, F2, F3 and F4 are laid end-to-end as described above with reference to FIG. 7. FIG. 12 shows the nose section assembled from panel components for placement in front of the canister half sections.

FIG. 12 also shows the wing defining flat sheet W laid over the canisters and fuselage components and a vertical tail surface provided on struts (not shown) but as described above with reference to FIGS. 1–9. The horizontal tail surfaces are flat vinyl sheets suitably imprinted to simulate the actual aircraft and laid over the aft fuselage panel F4.

In summary, this invention permits up to four decoy canisters to be transported on a standard military pallet, and each canister or decoy can be assembled by as few as two persons in a minimum of time. The black shadow sheet may have grommets to facilitate securing of this sheet by suitable means such as stakes provided to stake this sheet in place. The vertical fin is preferably supported on struts that are removably secured to the panels, and lines are preferably provided to further support these struts from stakes. All contents of the canisters can be put to efficient use in erecting the decoy with no requirement for disposing of the container or canister after the decoy has been erected. Ease of disassembly is, therefor, an added advantage of this unique decoy configuration.

Although the military hardware described above relates to fighter type aircraft other equipment can be simulated as well. A rectangular canister can be made with sections that simulate the body of a tank or truck for example, The term aircraft is intended to encompass helicopters as well as fixed wing aircraft such as the Harrier and the F-16 shown in the drawings.

I claim:

1. A method for quickly erecting a decoy of complex geometry such as that of a specific military equipment item, said method comprising:

providing a generally cylindrical canister of length (L), which canister includes several sections, each section having a cross sectional shape such that when the sections are assembled the canister has a vertical dimension of approximately one fourth said length $$\left(\frac{L}{4}\right),$$

providing a plurality of sheets rolled up inside the canister, which sheets are provided with indicia to simulate the appearance of a portion of the item of the decoy is to simulate, opening the canister, and placing several canister sections adjacent one another on a horizontal surface, laying a first sheet over the top of certain canister sections, said sheet including at least a portion that has been imprinted to simulate the surfaces of the item, providing struts in the canister, and securing these struts to the canister sections to support additional sheets to simulate surfaces of the item in addition to the portions represented on the first sheet.

2. The method according to claim 1 with a spanwise dimension, prior to the method step of placing the canisters on the horizontal surface, wherein the item to be simulated is an aircraft, and said shadow sheet includes wing portions deploying a shadow sheet on the horizontal surface to simulate the shadow of at least a wing portion of the item to be simulated, and then orienting the canister sections generally perpendicular to the shadow sheets spanwise dimension, storing three dimensional, contoured panels inside the canister, and providing imprinted sheets over said panels of specific aircraft components such as the aircraft nose, canopy, armament, fuselage tip tanks, and engine inlet, and placing said panels on or near the canister sections.

3. The method of claim 2 further including the additional step of providing additional support struts in the canister, inserting said struts in slots provided in the contoured panels, and securing additional imprinted sheets to said struts to simulate non-horizontal aircraft control surfaces.

4. The method of claim 3 wherein said assembled canister sections define a cylindrical shape.

5. The method of claim 4 wherein said canister sections are semi-cylindrical and when placed adjacent to one another over said shadow sheet serve to define at least a portion of the simulated fuselage of an aircraft.

6. The method of claim 5 wherein said canister sections are placed end-to-end.

7. The method of claim 6 wherein said canister sections are two in number and are placed alongside one another so that each section has a common longitudinally extending edge.

8. The method of claim 7 wherein said edges of said canister sections are hinged to facilitate the opening of said canister and deploying the decoy.

9. The method of claim 8 wherein said sheets comprise vinyl coated fabric suitably imprinted to represent those details of the aircraft that are normally used to identify the item but that are not readily seen from great distances as of three dimensional configuration.

* * * * *